US007694393B2

(12) United States Patent
Schlichter et al.

(10) Patent No.: US 7,694,393 B2
(45) Date of Patent: Apr. 13, 2010

(54) APPARATUS AT A CARDING MACHINE HAVING A CYLINDER AND CLOTHED AND/OR UNCLOTHED ELEMENTS LOCATED OPPOSITE THE CYLINDER

(75) Inventors: Stefan Schlichter, Viersen (DE); Axel S. Herrmann, Peine (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 1151 days.

(21) Appl. No.: 11/181,723

(22) Filed: Jul. 15, 2005

(65) Prior Publication Data

US 2006/0016049 A1 Jan. 26, 2006

(30) Foreign Application Priority Data

Jul. 23, 2004 (DE) ..... 10 2004 035 771

(51) Int. Cl.
*D01G 15/12* (2006.01)

(52) U.S. Cl. ..... 19/98

(58) Field of Classification Search ..... 19/98, 19/99

See application file for complete search history.

(56) References Cited

U.S. PATENT DOCUMENTS

| | | | | |
|---|---|---|---|---|
| 4,384,388 | A | 5/1983 | Mondini | |
| 4,499,632 | A | 2/1985 | Varga | |
| 5,127,134 | A | 7/1992 | Demuth et al. | |
| 5,920,961 | A | 7/1999 | Hollingsworth | |
| 6,219,885 | B1 | 4/2001 | Faas et al. | |
| 6,282,754 | B1 * | 9/2001 | Leder | 19/98 |
| 6,379,290 | B1 | 4/2002 | Sohl | |
| 2002/0069486 | A1 * | 6/2002 | Wust et al. | 19/102 |
| 2002/0152585 | A1 * | 10/2002 | Wust et al. | 19/103 |
| 2004/0154135 | A1 * | 8/2004 | Leder | 19/98 |
| 2005/0015988 | A1 | 1/2005 | Murakami et al. | |
| 2006/0019809 | A1 * | 1/2006 | Schlichter et al. | 492/50 |

FOREIGN PATENT DOCUMENTS

| | | |
|---|---|---|
| DE | 1 037 332 | 8/1958 |
| DE | 41 28 428 C2 | 7/1996 |
| DE | 195 33 823 A1 | 10/1996 |
| DE | 695 30 126 T2 | 6/1997 |

(Continued)

OTHER PUBLICATIONS

French Search Report dated Jun. 27, 2007, issued in FR Application No. 0507814.

(Continued)

*Primary Examiner*—Shaun R Hurley
(74) *Attorney, Agent, or Firm*—Venable LLP; Robert Kinberg; Leigh D. Thelen

(57) ABSTRACT

A carding machine has a number of rollers including a cylinder and having at least one clothed and/or unclothed machine element located opposite the cylinder at a spacing therefrom. The machine may have further elements influencing the carding nip. In order to make possible a carding nip between the cylinder and the clothed and/or unclothed counterpart element that remains constant or virtually constant when heat is generated, the parts influencing the carding nip are so construed that they have thermal expansion characteristics which are such that, when subjected to the heat acting on them in use, the carding nip remains substantially constant.

29 Claims, 6 Drawing Sheets

FOREIGN PATENT DOCUMENTS

| | | | |
|---|---|---|---|
| DE | 100 58 272 | A1 | 5/2002 |
| DE | 101 06 315 | A1 | 8/2002 |
| DE | 101 18 854 | A1 | 10/2002 |
| DE | 102 03 853 | A1 | 8/2003 |
| EP | 0 446 796 | A1 | 3/1991 |
| EP | 0 431 485 | B1 | 8/1997 |
| EP | 0 866 153 | A1 | 9/1998 |
| EP | 0 894 876 | A1 | 2/1999 |
| EP | 1 031 650 | A2 | 8/2000 |
| EP | 1 231 303 | A1 | 8/2002 |
| FR | 2 816 998 | A1 | 5/2002 |
| FR | 2 850 981 | A1 | 8/2004 |
| GB | 2 350 622 | A | 12/2000 |
| GB | 2 386 131 | A | 9/2003 |
| GB | 2 398 083 | A | 8/2004 |
| JP | 57-146912 | A | 9/1982 |
| WO | WO 79/00983 | A1 | 11/1979 |
| WO | WO-03/031160 | A1 | 4/2003 |
| WO | WO-2004/106602 | A1 | 12/2004 |

OTHER PUBLICATIONS

German Search Report dated Dec. 20, 2004, issued in corresponding German Patent Application No. 10 2004 035 770.6.

UK Search Report dated Oct. 5, 2005, issued in corresponding British Application No. GB0515038.8

French Search Report dated Nov. 30, 2006, issued in corresponding French Application No. 05 07815.

* cited by examiner

I - I

APPARATUS AT A CARDING MACHINE HAVING A CYLINDER AND CLOTHED AND/OR UNCLOTHED ELEMENTS LOCATED OPPOSITE THE CYLINDER

CROSS REFERENCE TO RELATED APPLICATION

The present application claims priority from German Patent Application No. 10 2004 035 771.4 dated Jul. 23, 2004, the entire disclosure of which is incorporated herein by reference.

BACKGROUND OF THE INVENTION

The invention relates to an apparatus at a carding machine, for example but not exclusively, a carding machine having a cylinder which has a cylindrical, clothed wall surface and at least two radial cylinder ends, and having at least one clothed and/or unclothed machine element located opposite the cylinder clothing at a spacing therefrom and two stationary side screens, on which there are mounted holding devices for work elements, for example sliding bends, stationary carding elements, cylinder coverings, which in use are subjected to heat.

The effective spacing of the tips of a clothing from a machine element located opposite the clothing is called a carding nip. The said machine element can also have a clothing but could, instead, be formed by an encasing segment having a guide surface. The carding nip is decisive for the carding quality. The size (width) of the carding nip is a fundamental machine parameter, which influences both the technology (the fibre processing) and also the running characteristics of the machine. The carding nip is set as narrow as is possible (it is measured in tenths of a millimeter) without running the risk of a "collision" between the work elements. In order to ensure that the fibres are processed evenly, the nip must be as uniform as possible over the entire working width of the machine.

The carding nip is especially influenced, on the one hand, by the machine settings and, on the other hand, by the condition of the clothing. The most important carding nip in a carding machine having a revolving card top is located in the main carding zone, that is to say between the cylinder and the revolving card top unit. At least one of the clothings bounding the work spacing is in motion, usually both. In order to increase the production of the carding machine, endeavours are made to make the speed of rotation or velocity of the moving elements, in use, as high as fibre processing technology will allow. The work spacing changes as a function of the operational conditions, the change occurring in the radial direction (starting from the axis of rotation) of the cylinder.

In carding, larger amounts of fibre material are increasingly being processed per unit time, which results in higher speeds for the work elements and higher installed capacities. Increasing fibre material throughflow (production) leads to increased generation of heat as a result of the mechanical work, even when the work surface remains constant. At the same time, however, the technological result of carding (web uniformity, degree of cleaning, reduction of neps etc.) is being continually improved, leading to more work surfaces in carding engagement and to closer settings of those work surfaces with respect to the cylinder (drum). The proportion of synthetic fibres being processed is continually increasing, with more heat, compared with cotton, being produced as a result of friction from contact with the work surfaces of the machine. The work elements of high-performance carding machines today are fully enclosed on all sides in order to meet the high safety standards, to prevent emission of particles into the spinning room environment and to minimise the maintenance requirement of the machines. Gratings or even open material-guiding surfaces, which allow an exchange of air, belong to the past. As a result of the circumstances mentioned, there is a marked increase in the input of heat into the machine whereas there is a marked decrease in the heat removed by means of convection. The resulting increase in the heating of high-performance carding machines results in greater thermoelastic deformations, which, because of the unequal temperature field distribution, influence the set spacings of the work surfaces: the spacings between the cylinder and the card top, doffer, fixed card tops and separating-off locations decrease. In extreme cases, the nip set between the work surfaces can be completely used up as a result of thermal expansion so that components in relative motion collide, causing major damage to the high-performance carding machine concerned. Additionally, it is especially possible for the generation of heat in the work region of the carding machine to result in different thermal expansions when the temperature differences between the components are too large.

In a known apparatus (EP 0 446 796 A), all parts influencing the work spacing (for example, the cylinder and the card top bars) are preferably fabricated from a material having a high elasticity modulus in order to reduce sagging over the working width. Such a material is, for example, steel or fibre-reinforced plastics material. The material selected has to ensure the desired dimensional accuracy of the part (in the case of the manufacturing procedure in question) and has to be able to maintain that in use. The material should accordingly exhibit less thermal expansion and/or greater thermal conductivity so that heat losses which occur (which are unavoidable at high production rates) do not result in disruptive deformation of the work elements. In the case of the known apparatus, the thermal expansion of the co-operating components influencing the work spacing, namely that of the cylinder (drum) and of the card top bars, is equal and homogeneous, because the components are made of the same material. Even though the material should exhibit less thermal expansion, the carding nip is reduced in undesirable manner—albeit to a small extent—which results in problems ranging from reduced carding quality to disruptions in operation. In addition, it is disadvantageous that widening of the cylinder as a result of centrifugal force cannot be reduced or avoided by the known measures.

It is an aim of the invention to provide an apparatus of the kind mentioned at the beginning that avoids or mitigates the mentioned disadvantages and that especially makes possible a carding nip or work spacing, between the cylinder clothing and the clothed and/or not clothed counterpart element, that remains constant or virtually constant when heat is generated.

SUMMARY OF THE INVENTION

The invention provides a carding machine having a carding nip and a plurality of machine elements that influence the carding nip, in which at least first and second machine elements influencing the carding nip are constructed to have thermal expansion characteristics which are such that when the first and second machine elements are subjected to heat generated in operation of the carding machine, the carding nip remains substantially constant.

In one preferred embodiment, the machine comprises first and second elements influencing the carding nip which are so constructed that, when subjected to heat generated in operation, they undergo no thermal expansion. In another preferred embodiment, at least one of said machine elements undergoes negative thermal expansion when subjected to heat in use. In a further preferred embodiment, at least one of said machine elements undergoes positive thermal expansion when subjected to heat in use.

In accordance with a first aspect of the invention, the parts influencing the carding nip (work spacing) (for example, the cylinder, the carding bars and the holding elements for the carding bars) are so constructed that they exhibit no, or virtually no, thermal expansion under the heat of operation. As a result, the carding nip does not change. In accordance with a second aspect of the invention, at least one part influencing the carding nip exhibits negative thermal expansion (contraction) so that a change in the carding nip caused, for example, by positive thermal expansion of a part influencing the carding nip is compensated. This is especially the case when the carding-nip-influencing carrying elements provided with clothings are located opposite one another and one carrying element, for example the cylinder, undergoes positive expansion as a result of heating and the other carrying element, for example the carding bars (card top bars), in contrast undergoes negative expansion, that is to say contracts and, to a certain extent, recedes. In accordance with a third aspect of the invention, at least one part influencing the carding nip exhibits positive thermal expansion (widening) so that a change in the carding nip caused, for example, by positive thermal expansion of a part influencing the carding nip is likewise compensated. This is especially the case when the carding-nip-influencing carrying elements are arranged next to one another and one carrying element, for example the cylinder, undergoes positive expansion as a result of heating and the other carrying element, for example the flexible bends, likewise undergoes positive expansion, that is to say becomes wider and as a result raises the card top bars relative to the cylinder. According to all three aspects of the invention, the carding nip remains the same or virtually the same in use.

Advantageously, a part influencing the carding nip, for example a flexible bend, is so constructed that it exhibits positive thermal expansion in use. Preferably, a part influencing the carding nip, for example a card top bar, is so constructed that it exhibits negative thermal expansion in use. Advantageously, the positive thermal expansion of a part influencing the carding nip is compensated by the negative thermal expansion of the corresponding counterpart element. Preferably, a part influencing the carding nip is so constructed that it exhibits no thermal expansion in use. Preferably, the carding nip is influenced by the cylinder and the at least one carding element. Advantageously, the carding nip is influenced by the holding device for the at least one carding element. Preferably, the holding device for the at least one carding element is formed by at least one element of the side part. Advantageously, the side part consists of a side screen and at least one guide element (flexible bend). Preferably, the side part consists of a side screen and at least one extension bend. Advantageously, the clothed machine elements are revolving card tops. Preferably, the clothed machine elements are stationary card tops. Advantageously, the cylinder is made, at least in part, of steel. Steel ensures the stability of the cylinder and has relatively high resistance to bending. Preferably, the cylinder is made, at least in part, of aluminium. Aluminium likewise ensures the stability of the cylinder and has a relatively low specific weight. Preferably, the material for the parts influencing the carding nip is, at least in part, a carbon fibre-reinforced plastics material (CFRP). Carbon has a density of 1.45 g/cm$^3$. The basic material comprises carbon fibres. The latter can be produced from plastics filaments, which are heated in the absence of air and consequently "carbonised". For example, they have a diameter of 0.007 mm. These fibres are embedded in a carrier substance (matrix) of synthetic resins. The forces acting on carbon fibres are taken up by the fibres substantially only in the line of force flux. The fibres are therefore mainly laid in parallel. If bending and torsional stresses do not come from just one direction, individual layers of fibres are advantageously placed on top of one another in different orientations. Preferably, the thermal expansion coefficient of the carbon fibre reinforced plastics material (CFRP) is adjustable. Zero adjustment means no change and negative adjustment results in contraction so that no thermal expansion or negative thermal expansion of the component(s) is produced. By that means, the materials of the cylinder and, for example, the side parts are so matched to one another that, under the heat acting on the parts influencing the carding nip in use, the carding nip remains constant. Advantageously, the cylinder of the carding machine comprises a metal cylinder and at least one circular cylindrical sheath made of carbon fibre reinforced plastics material (CFRP) surrounding the cylinder. Preferably, the flexible bend and/or the extension bend is/are made at least in part of carbon fibre reinforced plastics material (CFRP). Advantageously, the flexible bend and/or the extension bend is provided with a support (layer) of carbon fibre reinforced plastics material (CFRP). Preferably, the cylinder is made of a metallic material, for example steel, and the flexible bend and/or the extension bend is/are made at least in part of carbon fibre reinforced plastics material (CFRP). Advantageously, the card tops, for example revolving and/or stationary card tops, are made at least in part of carbon fibre reinforced plastics material (CFRP). Preferably, the side screen is made at least in part of carbon fibre reinforced plastics material (CFRP). Advantageously, at least one metal cylinder and at least one circular cylindrical sheath made of carbon fibre reinforced plastics material (CFRP) surrounding the cylinder are provided. Preferably, the metal cylinder and the sheath are mutually biased at room temperature and at operating temperature. Advantageously, the metal cylinder is subjected to compressive stresses and the sheath is subjected to tensile stresses in the circumferential direction. Preferably, the reinforcement fibres of CFRP in the sheath are oriented in the circumferential direction of the cylinder. As a result, widening of the cylinder as a result of centrifugal force is especially advantageously reduced or avoided, especially at high speeds of rotation. Advantageously, the cylinder is enclosed. Preferably, the removal of heat from the cylinder is different to that from the side parts. Advantageously, the roller is a licker-in of a flat card or roller card. Preferably, the roller is the doffer of a flat card or roller card.

DETAILED DESCRIPTION OF PREFERRED EMBODIMENTS

Figure 1:
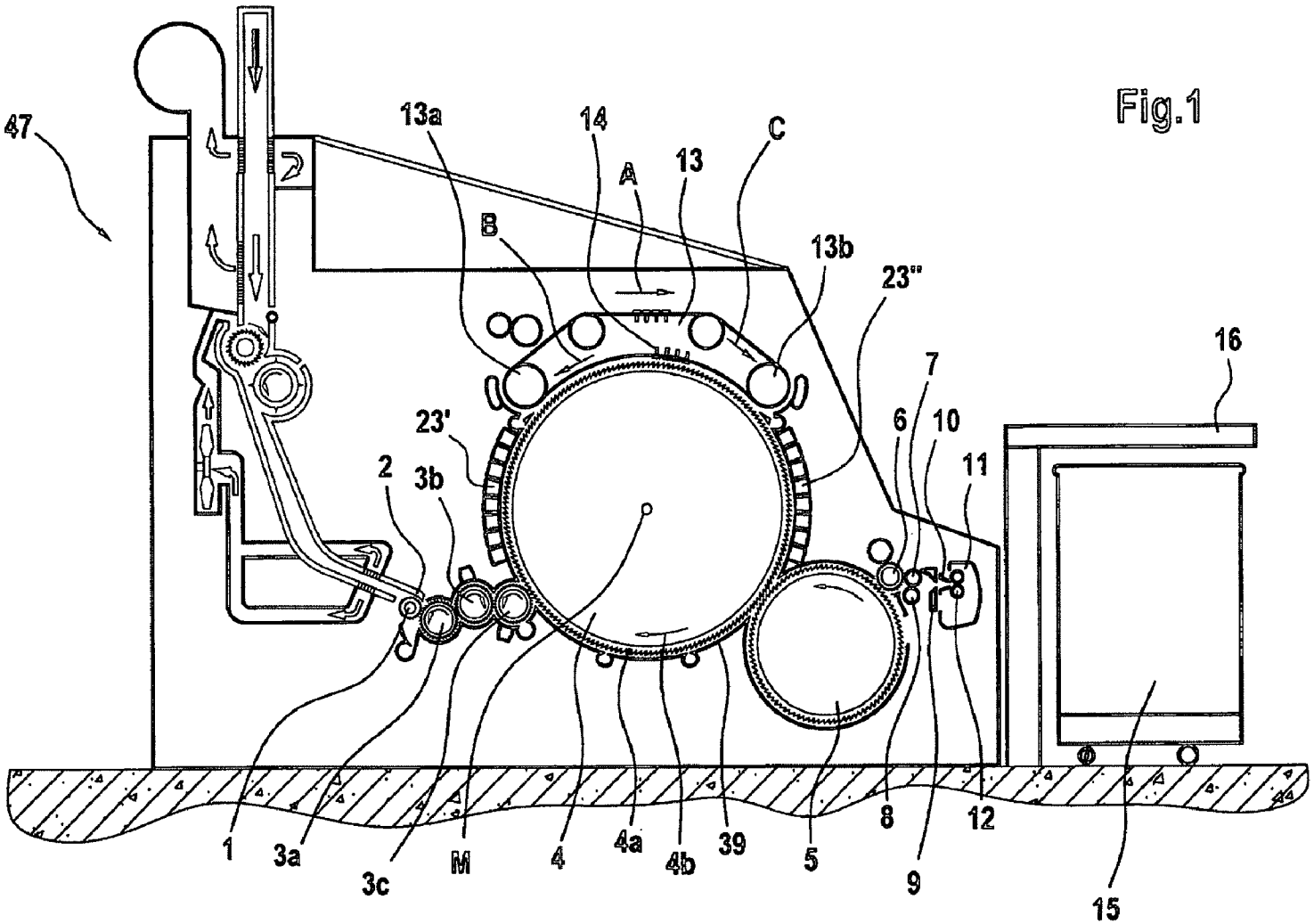
FIG. 1 is a diagrammatic side view of a carding machine with an apparatus according to the invention.

FIG. 1 shows a carding machine 47, for example a TC 03 carding machine made by Trützschler GmbH & Co. KG of Mönchengladbach, Germany, having a feed roller 1, feed table 2, lickers-in 3*a*, 3*b*, 3*c*, cylinder 4, doffer 5, stripper roller 6, nip rollers 7, 8, web-guiding element 9, web funnel 10, draw-off rollers 11, 12, revolving card top 13 having card-top-deflecting rollers 13*a*, 13*b* and card top bars 14, can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. Reference letter B denotes the direction of rotation of the revolving card top 13 at the carding location and reference letter C denotes the direction in which the card top bars 14 are moved on the reverse side. Reference numerals 23', 23" denote stationary carding elements and reference numeral 39 denotes a cover underneath the cylinder 4. Arrow A denotes the work direction.

Figure 2:
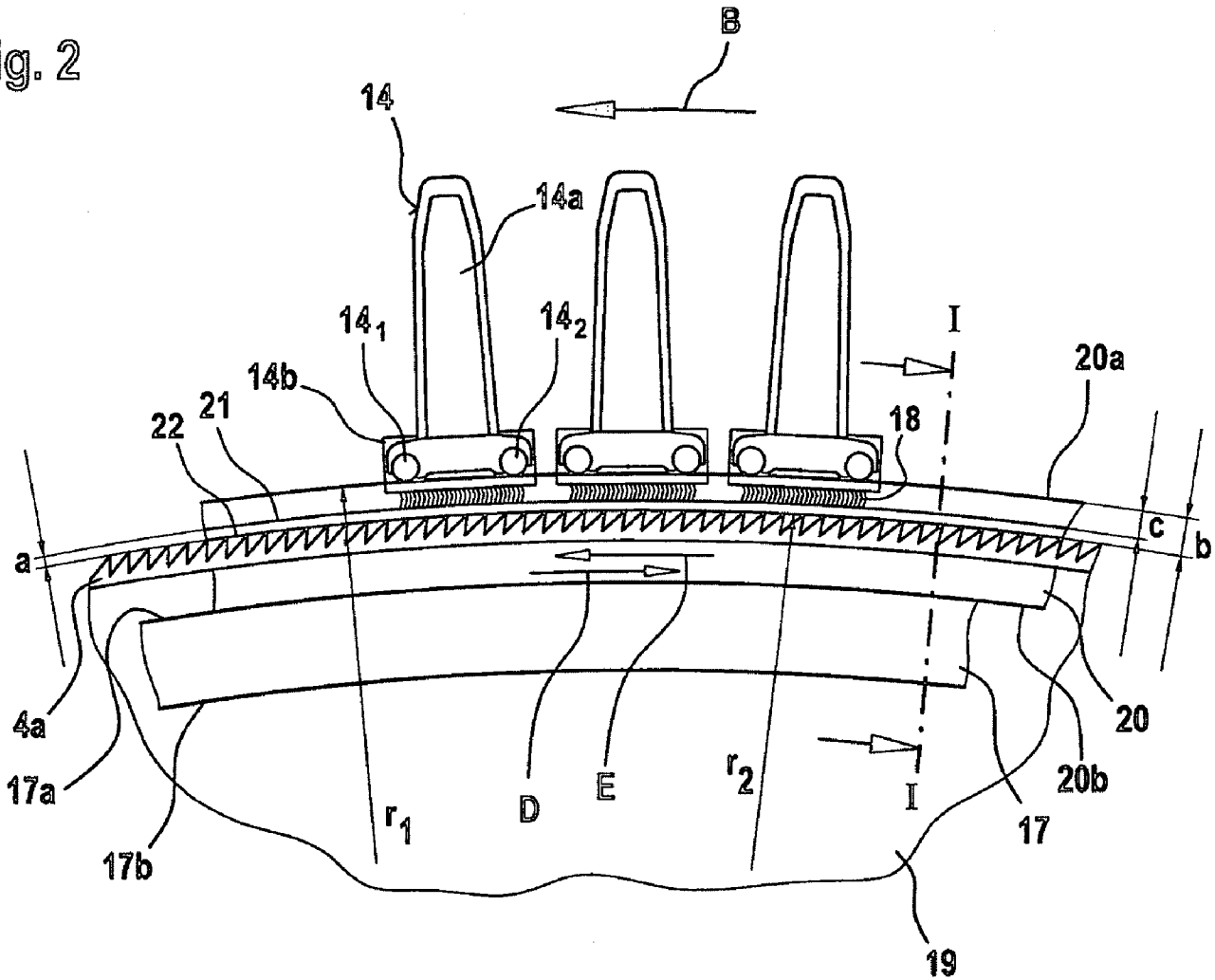
FIG. 2 shows card top bars of the revolving card top of the carding machine of FIG. 1 and portions of a slideway, of the flexible bend, of the side screen and of the cylinder, and also the carding nip between the clothings of the card top bars and the cylinder clothing.
Figure 4:
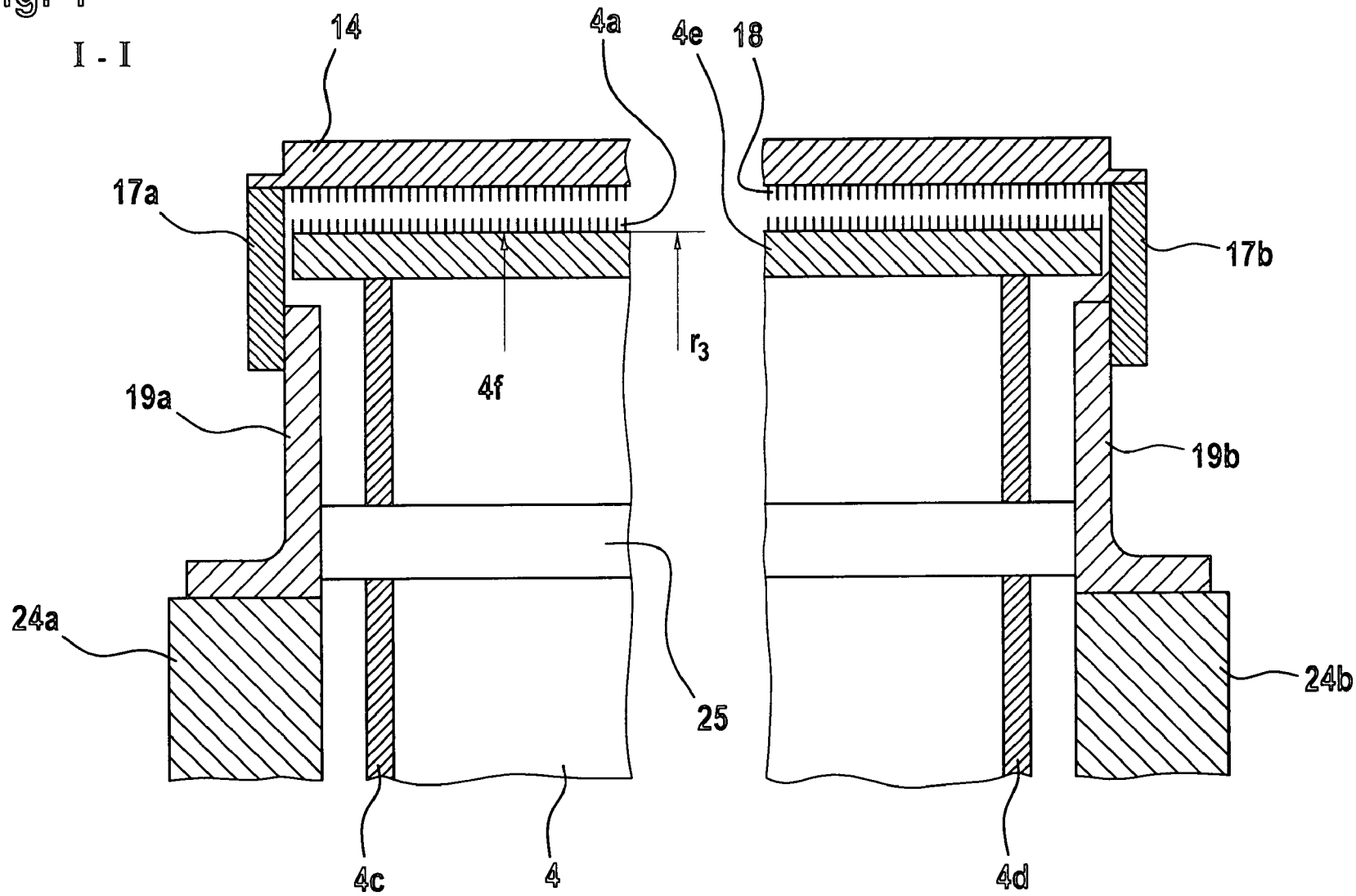
FIG. 4 is a diagrammatic section through a slideway along the line I-I in FIG. 2 together with flexible bends and side screens.

In accordance with FIG. 2, on each side of the carding machine, a flexible bend 17 having several adjustment screws is fixed laterally to the side screen 19*a*, 19*b* (see FIG. 4). The flexible bend 17 has a convex outer surface 17*a* and an underside 17*b*. On top of the flexible bend 17 there is a slideway 20, for example made of low-friction plastics material, which has a convex outer surface 20*a* and a concave inner surface 20*b*. The concave inner surface 20*b* rests on top of the convex outer surface 17*a* and is able to slide thereon in the direction of arrows D, E. Each card top bar consists of a rear part 14*a* and a carrying member 14*b*. Each card top bar 14 has, at each of its two ends, a card top head, each of which comprises two steel pins $\mathbf{14}_1$, $\mathbf{14}_2$. Those portions of the steel pins $\mathbf{14}_1$, $\mathbf{14}_2$ that extend out beyond the end faces of the carrying member 14*b* slide on the convex outer surface 20*a* of the slideway 20 in the direction of the arrow B. A clothing 18 is attached to the underside of the carrying member 14*b*. Reference numeral 21 denotes the circle of tips of the card top clothings 18. The cylinder 4 has on its circumference a cylinder clothing 4*a*, for example a sawtooth clothing. Reference numeral 22 denotes the circle of the tips of the cylinder clothing 4*a*. The spacing (carding nip) between the circle of tips 21 and the circle of tips 22 is denoted by reference letter a and is, for example, 3/1000". The spacing between the convex outer surface 20*a* and the circle of tips 22 is denoted by reference letter b. The spacing between the convex outer surface 20*a* and the circle of tips 21 is denoted by reference letter c. The radius of the convex outer surface 20*a* is denoted by reference letter $r_1$ and the radius of the circle of tips 22 is denoted by reference letter $r_2$. The radii $r_1$ and $r_2$ intersect at the centre point M of the cylinder 4. Reference numeral 19 denotes the side screen.

Figure 3A:
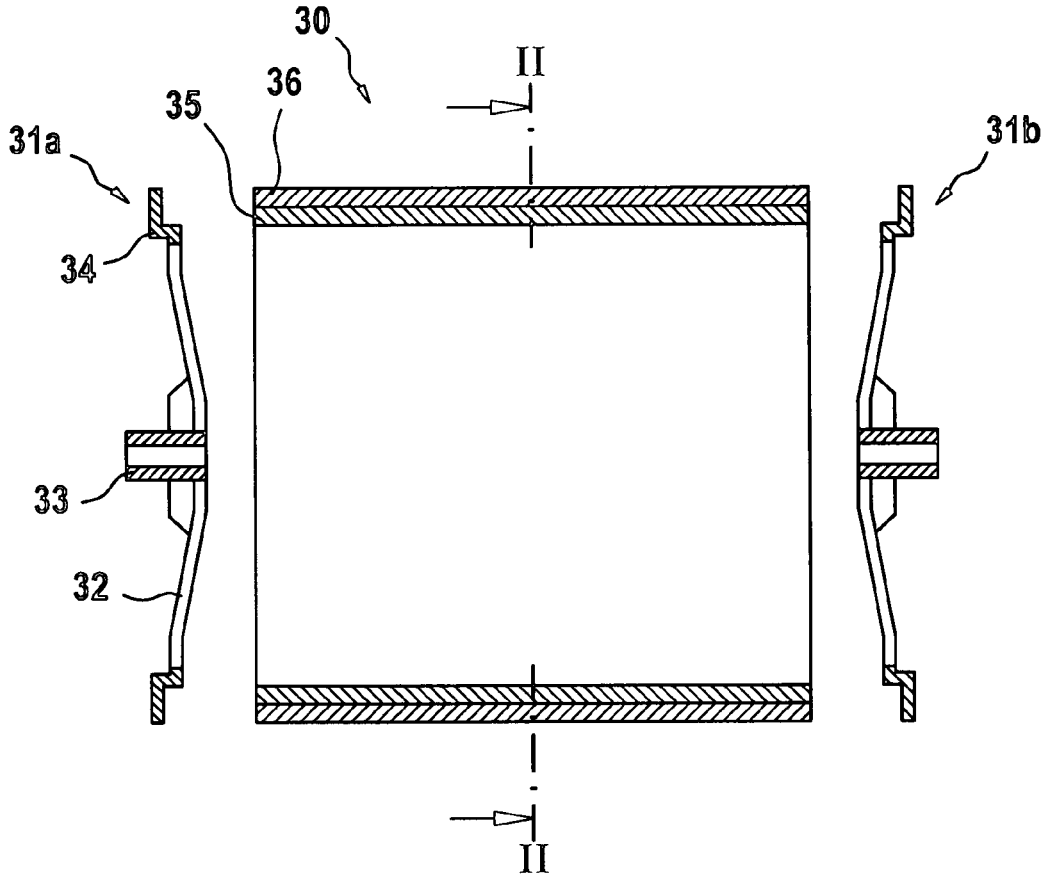
FIGS. 3*a*, 3*b* show sections through a roller comprising a metal cylinder and a circular cylindrical sheath made of carbon fibre reinforced plastics material surrounding the cylinder, in a front view (FIG. 3*a*) and side view (FIG. 3*b*)
Figure 3B:
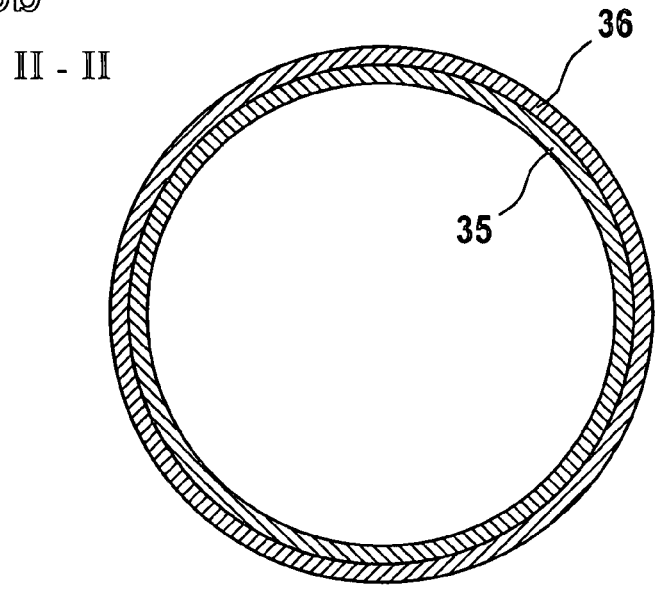

The high-speed roller shown in FIGS. 3*a*, 3*b* for a fibre-processing machine, for example a cylinder 4 of a carding machine, consists of a hollow cylindrical roller body 30 and two roller ends 31*a*, 31*b* at the end faces. The roller ends 31*a*, 31*b* advantageously are made of metal, for example steel or aluminium. Reference numeral 32 denotes a spoke, reference numeral 33 a hub and reference numeral 34 an end flange. The roller body 30 consists of an internal steel cylinder 35 and an external hardened CFRP sheath 36. The CFRP sheath 36 has the shape of a thin-walled hollow cylinder. At operating temperature, in the biased state, compressive stresses are present in the circumferential direction in the cylindrical wall region of the steel cylinder 35 and tensile stresses in the cylindrical CFRP sheath 36. In use, because of the centrifugal force to which the steel cylinder 35 is subjected, the compressive stresses are reduced. The thermal expansion coefficient of the cylinder material is much greater than the thermal expansion coefficient of the carbon fibre reinforced plastics material in the direction of the reinforcement fibres; for example, the thermal expansion coefficient $\alpha$ of steel is between $11\times10^{-6}$ 1/K and $17\times10^{-6}$ 1/K and that of CFRP in the fibre direction is about zero, especially between $-2\times10^{-6}$ 1/K and $+2\times10^{-6}$ 1/K. When subjected to heat in use, the internal diameter of the CFRP sheath 36 accordingly changes only very slightly, whereas the thermal expansion of the steel cylinder 35 is considerable. The thermal expansion of the CFRP-sheathed steel cylinder 35 is consequently less than the thermal expansion of a cylinder having an all-steel wall.

A roller according to the invention, comprising a metal cylinder and a composite fibre sheath, is lighter in comparison to an all-steel or all-aluminium roller, has a reduced mass inertia and exhibits linear thermal expansion which is adjustable (down to negative values) as a result of constructively arranged fibre orientation. The advantages of the roller according to the invention in use, which result from the properties of the material, are, for example, substantially improved braking values, savings in terms of drive units, energy savings, higher production rates, wider working widths and vibration-free running.

Density, specific rigidity and specific strength—the table that follows lists the density, modulus of elasticity and strength of the materials in comparison with one another:

| Material | Density ($g/cm^3$) | Modulus of elasticity ($N/mm^2$) | Strength (MPa) |
|---|---|---|---|
| St 52 | 7.8 | 210 000 | 400 |
| Al | 2.7 | 70 000 | 350 |
| CFRP | 1.3 | 75 000 to 180 000 | 1500 |
| GFRP* | 1.9 | 20 000 to 40 000 | 1250 |

*Glass fibre-reinforced plastics material

In the direction of the fibres, CFRP has considerable advantages compared to steel (the latter being represented by St 52 in the above table). The individual fibres made up into a tube in the course of a winding process determine the anisotropic (directionally dependent) behaviour of such a tube.

FIG. 4 shows part of the cylinder 4 together with the cylindrical surface 4*f* of its wall 4*e* and the cylinder ends 4*c*, 4*d* (radial supporting elements). The surface 4*f* is provided with a clothing 4*a*, which in this example is provided in the form of wire with sawteeth. The sawtooth wire is drawn onto the cylinder 4, that is to say is wound around the cylinder 4 in tightly adjacent turns between side flanges (not shown), in order to form a cylindrical work surface provided with tips. Fibres should be processed as evenly as possible on the work surface (clothing). The carding work is performed between the clothings 18 and 4*a* located opposite one another and is substantially influenced by the position of one clothing with respect to the other and by the clothing spacing a between the tips of the teeth of the two clothings 18 and 4*a*. The working width of the cylinder 4 is a determining factor for all other work elements of the carding machine, especially for the revolving card tops 14 or stationary card tops 23', 23" (FIG. 1), which together with the cylinder 4 card the fibres evenly over the entire working width. In order to be able to perform even carding work over the entire working width, the settings of the work elements (including those of additional elements) must be maintained over that working width. The cylinder 4 itself can, however, be deformed as a result of the drawing-on of the clothing wire, as a result of centrifugal force or as a result of heat produced by the carding process. The shaft 25 of the cylinder 4 is mounted in positions (not shown) located on the stationary machine frame 24*a*, 24*b*. The diameter, for example 1250 mm, of the cylindrical surface 4*f*, that is to say twice the radius $r_3$, is an important dimension of the machine and becomes larger in use as a result of the heat of work. The side screens 19*a*, 19*b* are fastened to the two machine frames 24*a* and 24*b*, respectively. The flexible bends 17*a* and 17*b* are fastened to the side screens 19*a* and 19*b*, respectively.

When heat is produced in use in the carding nip a between the clothings 18 (or in the carding nip d between the clothings 23') and the cylinder clothing 4*a* as a result of carding work, especially in the case of a high production rate and/or the processing of synthetic fibres or of cotton/synthetic fibre blends, the cylinder wall 4*e* undergoes expansion, that is to say the radius $r_3$ increases and the carding nip a (se FIG. 2) or d (see FIG. 7*a*) decreases. The heat is directed via the cylinder wall 4*e* into the radial carrying elements, the cylinder ends 4*c* and 4*d*. The cylinder ends 4*c*, 4*d* likewise undergo expansion as a result thereof, that is to say the radius increases. The cylinder 4 is almost entirely encased (enclosed) on all sides —in a radial direction by the elements 14, 23, 39 (see FIG. 1) and to the two sides of the carding machine by the elements 17*a*, 17*b*, 19*a*, 19*b*, 24*a*, 24*b*. As a result, scarcely any heat is radiated from the cylinder 4 to the outside (to the atmosphere). Nevertheless, the heat of the cylinder ends 4*c*, 4*d* of large surface area is especially conveyed by means of radiation to the side screens 19*a*, 19*b* of large surface area to a considerable extent, from where the heat is radiated out to the colder atmosphere. As a result of that radiation, the expansion of the side screens 19*a*, 19*b* is less than that of the cylinder ends 4*c*, 4*d*, which results in a reduction in the carding nip a (FIG. 2*a*) and in the carding nip d (FIG. 7*a*) that ranges from undesirable (in terms of the result of carding) to hazardous. The carding elements (card top bars 14) are mounted on the flexible bends 17*a*, 17*b* and the fixed carding elements 23', 23" are mounted on the extension bends, which are in turn fixed to the side screens 19*a*, 19*b*. In the event of heating, the lifting of the flexible bends 17*a*, 17*b*—and, as a result, of the clothings 18 of the card top bars 14 —increases less, compared to the expansion of the radius $r_3$ of the cylinder wall 4*e*—and, as a result, of the clothing 4*a* of the cylinder 4 —, which results in narrowing of the carding nip a. The cylinder wall 4*e* and the cylinder ends 4*c*, 4*d* are made of steel, for example St 37, having a linear thermal expansion coefficient of $11.5\times10^{-6}$ [1/° K]. In order then to compensate for the relative differences in the expansion of the cylinder ends 4*c*, 4*d* and the cylinder wall 4*e*, on the one hand, and the side screens 19*a*, 19*b* (as a result of impeded radiation into the atmosphere because of encasing of the cylinder 4 and free radiation into the atmosphere from the side screens), the rear parts 14*a* and carrying members 14*b* of the card top bars are made of carbon fibre reinforced plastics material (CFRP) whose thermal expansion coefficient has been negatively adjusted. By that means, even though the expansion of the cylinder 4 remains the same because of a lack of removal of heat as a result of encasing, the card top bars 14 undergo contraction. As a result, undesirable reduction in the carding nip a and d due to thermal influences is avoided.

Figure 5:
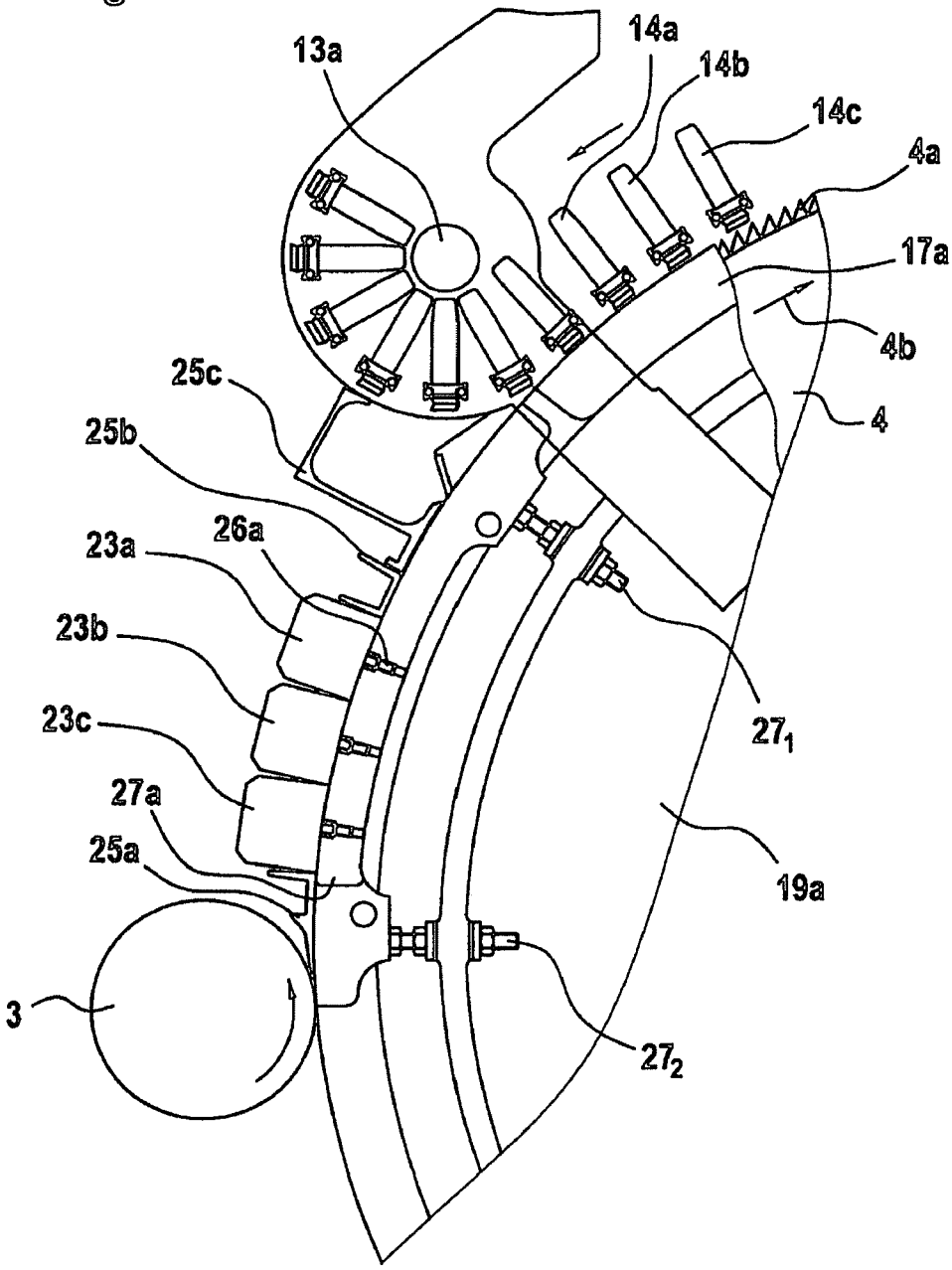
FIG. 5 is a side view of a part of a side screen and flexible bend, cylinder, extension bend, stationary carding element and revolving card top bars.

In the embodiment of FIG. 5, three non-moving stationary carding elements 23*a*, 23*b*, 23*c* and non-clothed cylinder-encasing elements 25*a*, 25*b*, 25*c* are provided between the licker-in 3 and the card-top-deflecting roller 13*a*. In accordance with FIG. 7*a*, the stationary carding elements 23 have a clothing 23', which is located opposite the cylinder clothing 4*a*. Reference letter d denotes the carding nip between the clothing 23' and the cylinder clothing 4*a*. The stationary carding elements 23, by means of screws 26*a*, and the cover elements 25 (by means of screws which are not shown) are mounted on an extension bend 27*a* (the extension bend 27*a* on only one side of the carding machine is shown in FIG. 3), which is in turn fastened by means of screws $\mathbf{27}_1$ to $\mathbf{27}_2$ to the card screen 19*a* and 19*b* (only 19*a* is shown in FIG. 5) on each side of the carding machine. The flexible bends 17*a*, 17*b* (only 17*a* is shown in FIG. 5) are fastened to the side screens 19*a* and 19*b*, respectively, by means of screws $\mathbf{29}_1$, $\mathbf{29}_2$ (see FIG. 6).

Figure 6:
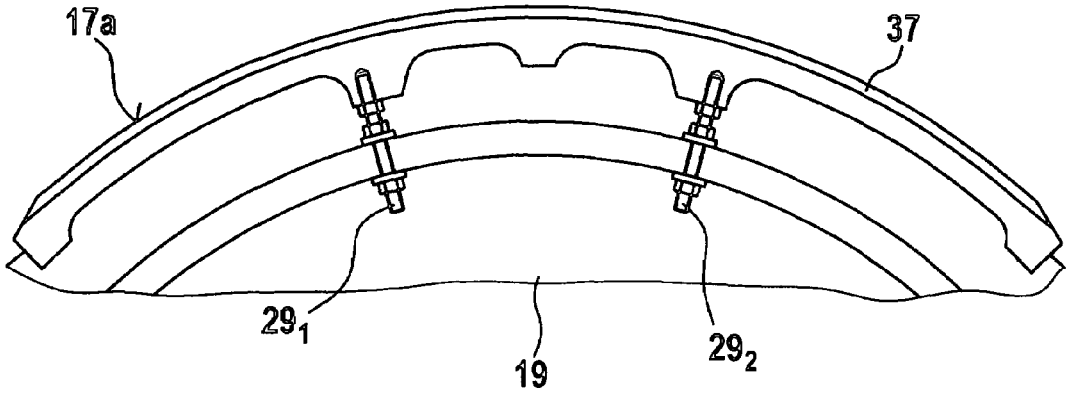
FIG. 6 is a side view of a flexible bend according to the invention.
Figure 7:
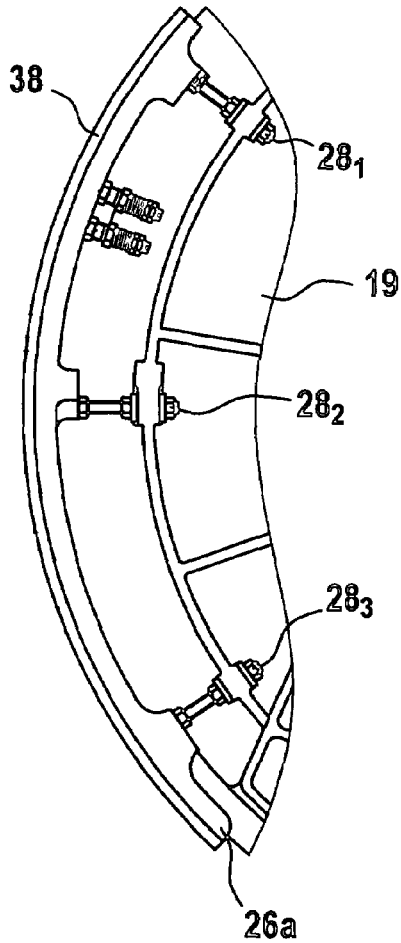
FIG. 7 is a side view of an extension bend according to the invention in the pre-carding zone.
Figure 7A:
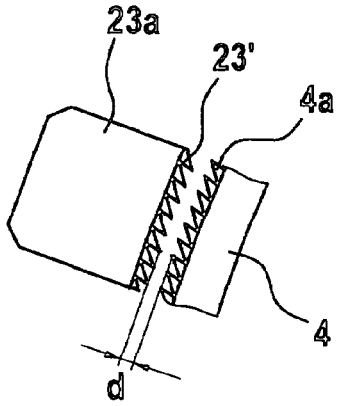
FIG. 7*a* shows the carding nip between the clothing of a stationary carding element according to the invention and the cylinder clothing.

FIGS. 6 and 7 show, as separate components, the flexible bend 17*a* and the extension bend 26*a*, respectively. The flexible bend 17*a* is made, for example, of GGG 30 grey cast iron, and the extension bend is made, for example, of GG 20 grey cast iron. On the convexly curved periphery of the flexible bend there is fixed a coating 37 and on that of the extension bend 26*a* there is fixed a coating 38, the two coatings 37, 39 being made of CFRP having positively adjusted thermal expansion coefficients.

The cylinder 4 is made, for example, of steel. In order to counteract, in use, the undesirable narrowing of the carding nips a (FIG. 2) and d (FIG. 7*a*), the flexible bends 17*a*, 17*b* and the extension bends 26, 26*b* are respectively provided with the coating 37 (FIG. 6) and 38 (FIG. 7) of carbon fibre reinforced plastics material (CFRP) whose thermal expansion coefficient has been positively adjusted. As a result, even though the expansion of the cylinder 4 is unchanged, the flexible bends 17*a*, 17*b* and extension bends 26*a*, 26*b* arranged to the sides of the cylinder 4 undergo expansion, as a result of which the card top bars 14 and stationary carding segments 23, respectively, are lifted up so that the undesirable reduction in the carding nip a and d, respectively, is avoided.

The arrangement of the flexible bends 17*a*, 17*b* and extension bends 26*a*, 26*b* shown in FIGS. 5 to 7 can advantageously be combined with the arrangement of the cylinder 4 shown in FIGS. 3*a*, 3*b*. In that combination, the flexible bends 17*a*, 17*b* and extension bends 26*a*, 26*b* are made at least sometimes of CFRP having a positively adjusted thermal expansion coefficient and the sheath 36 of the cylinder 4 (see FIGS. 3*a*, 3*b*) is made of CFRP having a negatively adjusted thermal expansion coefficient. Where appropriate, CFRP having a thermal expansion coefficient of zero can also be selected, depending on the material of the cylinder 4. By that means, as a result of suitable adjustment of the thermal expansion coefficients, a desired dimensional accuracy can be achieved and maintained as intended for the parts influencing the carding nip a and d in use when heat is generated.

In order to compensate for the relative differences in the expansion of the cylinder ends 4*c*, 4*d* and the cylinder wall 4*e*, on the one hand, and the side screens 19*a*, 19*b* (as a result of impeded radiation into the atmosphere because of encasing of the cylinder 4 and free radiation into the atmosphere from the side screens), the sheath 36 is, in accordance with a further arrangement, made of carbon fibre reinforced plastics material (CFRP) whose thermal expansion coefficient has been negatively adjusted. By that means, expansion of the cylinder 4 because of a lack of removal of heat as a result of encasing is reduced or avoided. As a result, undesirable reduction in the carding nip a or d due to thermal influences is avoided.

Although the foregoing invention has been described in detail by way of illustration and example for purposes of understanding, it will be obvious that changes and modifications may be practised within the scope of the appended claims.

What is claimed is:

1. A carding machine having a carding nip, comprising:

a carding cylinder having a positive thermal expansion coefficient and a support structure adapted to hold card top clothing at a distance from the carding cylinder to define a carding nip, wherein the support structure has a negative thermal expansion coefficient, and wherein the positive thermal expansion coefficient and the negative thermal expansion coefficient are selected to maintain a substantially constant carding nip when subjected to heat generated by normal operation of the carding machine.

2. A carding machine according to claim 1, wherein the carding cylinder is enclosed.

3. A carding machine according to claim 1 wherein the carding cylinder comprises at least one of a licker-in or a doffer.

4. A carding machine according to claim 1, wherein the support structure comprises a holding device that holds the card top clothing at a distance from the carding cylinder.

5. A carding machine according to claim 1, wherein the support structure comprises a side screen that holds the card top clothing at a distance from the carding cylinder.

6. A carding machine according to claim 1, wherein the support structure comprises a side screen and a flexible bend.

7. A carding machine according to claim 1, wherein the support structure comprises a side screen and an extension bend.

8. Apparatus according to claim 1, wherein the support structure comprises a card top bar.

9. A carding machine according to claim 1, wherein the carding cylinder comprises at least one of steel or aluminum.

10. A carding machine according to claim 1, wherein the support structure comprises a carbon fibre-reinforced plastics material.

11. A carding machine according to claim 10, wherein the thermal expansion coefficient of the carbon fibre reinforced plastics material is adjustable.

12. A carding machine having a carding nip, comprising:

a carding cylinder having a positive thermal expansion coefficient and a cylindrical sheath surrounding the carding cylinder, wherein the cylindrical sheath has a negative thermal expansion coefficient, and wherein the positive thermal expansion coefficient and the negative thermal expansion coefficient are selected to maintain a substantially constant carding nip when subjected to heat generated by normal operation of the carding machine.

13. A carding machine according to claim 12, wherein the carding cylinder and the cylindrical sheath are mutually biased at room temperature and at operating temperature.

14. A carding machine according to claim 12, wherein the carding cylinder is subjected to compressive stresses and the cylindrical sheath is subjected to tensile stresses in the circumferential direction.

15. A carding machine according to claim 12, wherein the carding cylinder comprises at least one of steel or aluminum.

16. A carding machine according to claim 12, wherein the cylindrical sheath comprises a carbon fibre-reinforced plastics material.

17. A carding machine according to claim 16, wherein the thermal expansion coefficient of the carbon fibre reinforced plastics material is adjustable.

18. A carding machine having a carding nip, comprising:

a carding cylinder having a positive thermal expansion coefficient and a support structure adapted to couple a shaft of the carding cylinder to a card top bar, wherein the support structure has a positive thermal expansion coefficient, and wherein the positive thermal expansion coefficients of the carding cylinder and the support structure are selected maintain a substantially constant carding nip when subjected to the heat generated by normal operation of the carding machine.

19. A carding machine according to claim 18, wherein the support structure comprises at least one of a flexible bend or an extension bend.

20. A carding machine according to claim 18, wherein the carding cylinder comprises at least one of steel or aluminum.

21. A carding machine according to claim 18, wherein the support structure comprises cast iron with a carbon fibre-reinforced plastics coating.

22. A carding machine according to claim 21, wherein the thermal expansion coefficient of the carbon fibre reinforced plastics coating is adjustable.

23. A carding machine having a carding nip, comprising:

a cylindrical sheath having a negative thermal expansion coefficient and at least one of a flexible bend or an extension bend having a positive thermal expansion coefficient, wherein the negative thermal expansion coefficient and the positive thermal expansion coefficient are selected to maintain a substantially constant carding nip subjected to heat generated by normal operation of the carding machine.

24. A carding machine according to claim 23, wherein the at least one of a flexible bend or expansion bend comprise, at least in part, cast iron with a carbon fibre reinforced plastics coating.

25. A carding machine according to claim 23, wherein the cylindrical sheath comprises a carbon fibre-reinforced plastics material.

26. A carding machine according to claim 25, wherein reinforcement fibres of the carbon fibre-reinforced plastics material in the cylindrical sheath are oriented largely in the circumferential direction of the carding cylinder.

27. A carding machine according to claim 25, wherein the thermal expansion coefficient of the carbon fibre reinforced plastics material is adjustable.

28. A carding machine having a carding nip, comprising a carding cylinder and a support structure, each having a respective thermal expansion coefficient that is selected to maintain a substantially constant carding nip when raised to operating temperature of the machine from the heat generated by normal operation of the carding machine, by virtue of one or more of (a) the carding cylinder having a positive thermal expansion coefficient and the support structure haying a negative thermal expansion coefficient; or (b) the carding cylinder having a positive thermal expansion coefficient and the support structure having a positive thermal expansion coefficient.

29. Apparatus according to claim 28, wherein the support structure comprises at least one of a card top bar, a holding device, a side screen, a side screen and flexible bend, or a side screen and extension bend.

* * * * *